US011319707B1

(12) United States Patent
Ayres

(10) Patent No.: US 11,319,707 B1
(45) Date of Patent: May 3, 2022

(54) COLLATED REBAR CLINCH CLIP

(71) Applicant: Don Ayres, Northbrook, IL (US)

(72) Inventor: Don Ayres, Northbrook, IL (US)

( * ) Notice: Subject to any disclaimer, the term of this patent is extended or adjusted under 35 U.S.C. 154(b) by 0 days.

(21) Appl. No.: 17/308,842

(22) Filed: May 5, 2021

Related U.S. Application Data

(60) Provisional application No. 63/020,536, filed on May 5, 2020.

(51) Int. Cl.
*E04C 5/16* (2006.01)
*E04G 21/12* (2006.01)

(52) U.S. Cl.
CPC ..... *E04C 5/167* (2013.01); *E04G 21/122* (2013.01)

(58) Field of Classification Search
CPC ..... E04C 5/166; E04C 5/167; E04C 5/168; E04G 21/122
See application file for complete search history.

(56) References Cited

U.S. PATENT DOCUMENTS

| | | | | |
|---|---|---|---|---|
| 721,434 | A | 2/1903 | Edebum | |
| 1,451,717 | A | 4/1923 | Sommer | |
| 1,986,528 | A * | 1/1935 | Ranger | E04C 5/166 52/719 |
| 2,455,557 | A | 12/1948 | Burner | |
| 2,622,634 | A | 12/1952 | Hill | |
| 2,702,182 | A | 2/1955 | Wenger | |
| 2,722,006 | A | 11/1955 | Ingram | |
| 2,923,008 | A | 2/1960 | Ingram | |
| 3,360,883 | A | 1/1968 | Glanzer | |
| 3,461,536 | A | 8/1969 | Skold | |
| 3,583,056 | A | 6/1971 | Klenz | |
| 3,694,988 | A | 10/1972 | Skold | |
| 3,945,238 | A | 3/1976 | Eckert | |
| 4,110,951 | A | 9/1978 | Padrun | |
| 4,388,791 | A | 6/1983 | Anderson | |
| 4,546,528 | A | 10/1985 | Langas | |
| 4,617,775 | A | 10/1986 | Padrun | |
| 4,991,372 | A | 2/1991 | Sonneville | |
| 5,020,355 | A | 6/1991 | Payne et al. | |
| 5,217,049 | A | 6/1993 | Forsyth | |
| D355,582 | S | 2/1995 | Sleight | |
| 5,598,682 | A | 2/1997 | Haughian | |

(Continued)

FOREIGN PATENT DOCUMENTS

| | | | | |
|---|---|---|---|---|
| DE | 823648 C | * | 12/1951 | E04C 5/167 |
| KR | 20030070194 A | * | 8/2003 | |
| WO | WO-0126974 A2 | * | 4/2001 | E04C 5/0604 |

*Primary Examiner* — Adriana Figueroa
(74) *Attorney, Agent, or Firm* — John C. Shepard

(57) ABSTRACT

A collated rebar clinch clip has three components including a pair of spaced U-shaped crimp elements and a U-shaped bridge element connecting the crimp elements. The crimp elements and bridge element are cut from continuous lengths of stock material. A plurality of clinch clips are joined together by a pair of cords to form a collated series of clinch clips that may be arranged in a linear series or spirally wound to form a coil. The tool includes a frame, a die set with a sliding blade and a fixed anvil, an actuator to linearly move the blade relative to the anvil, and a magazine to hold collated clinch clips for sequential delivery between the blade and anvil to tie together a first length of rebar extending through the bridge element and a second orthogonal length of rebar extending through the crimp elements.

20 Claims, 17 Drawing Sheets

(56) References Cited

U.S. PATENT DOCUMENTS

| | | | | |
|---|---|---|---|---|
| 5,626,436 | A | 5/1997 | Dragone | |
| 5,878,546 | A | 3/1999 | Westover | |
| 5,881,452 | A | 3/1999 | Nowell, III et al. | |
| 5,893,252 | A | 4/1999 | Hardy, Jr. et al. | |
| 5,938,099 | A | 8/1999 | Ciccarelli | |
| 6,112,494 | A | 9/2000 | Hardy, Jr. et al. | |
| 6,128,882 | A | 10/2000 | Jones | |
| 6,161,360 | A | 12/2000 | Smith | |
| 6,276,108 | B1 | 8/2001 | Padrun | |
| 6,317,970 | B1 | 11/2001 | Leistner et al. | |
| 6,347,904 | B1 * | 2/2002 | Knighton | E04C 5/166 248/65 |
| 6,725,535 | B2 | 4/2004 | Edson et al. | |
| D529,794 | S * | 10/2006 | Murray | D8/396 |
| D534,418 | S * | 1/2007 | Minor | D8/354 |
| 7,241,071 | B2 | 7/2007 | Carraher et al. | |
| 7,377,083 | B2 | 5/2008 | McCafferty et al. | |
| 7,559,532 | B1 | 7/2009 | Kodi | |
| 7,891,074 | B2 | 2/2011 | Kodi | |
| 7,900,419 | B2 | 3/2011 | Kodi | |
| 7,908,723 | B1 | 3/2011 | Kodi | |
| 7,963,392 | B2 | 6/2011 | Kodi | |
| 8,112,964 | B2 | 2/2012 | Baruh | |
| 8,117,796 | B2 | 2/2012 | Kodi | |
| 8,322,006 | B1 | 12/2012 | Kodi | |
| 8,402,634 | B2 | 3/2013 | Liu et al. | |
| 8,640,323 | B2 | 2/2014 | Kodi | |
| 8,776,328 | B2 | 7/2014 | Kodi | |
| 8,955,679 | B2 | 2/2015 | Kodi | |
| D737,131 | S | 8/2015 | Frandsen | |
| 9,267,288 | B2 | 2/2016 | Kodi | |
| 9,394,692 | B2 | 7/2016 | Kodi | |
| 9,797,148 | B2 | 10/2017 | Kodi | |
| 9,816,273 | B2 | 11/2017 | Yi | |
| 9,869,092 | B1 | 1/2018 | Rush | |
| 10,519,660 | B2 | 12/2019 | Evans | |
| 2004/0040247 | A1 | 3/2004 | Morse | |
| 2004/0154261 | A1 | 8/2004 | Miller | |
| 2005/0217198 | A1 | 5/2005 | Transgrud | |
| 2007/0284385 | A1 | 12/2007 | Carraher et al. | |
| 2010/0304117 | A1 * | 12/2010 | Scott | E04C 5/168 428/223 |
| 2013/0180200 | A1 | 7/2013 | Gavin | |
| 2014/0215955 | A1 | 8/2014 | Coleman | |
| 2016/0100620 | A1 | 5/2016 | Yun et al. | |
| 2018/0266110 | A1 | 9/2018 | Munsell et al. | |

* cited by examiner

Fig. 12
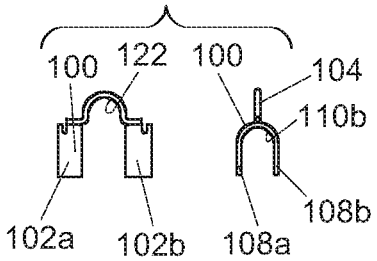
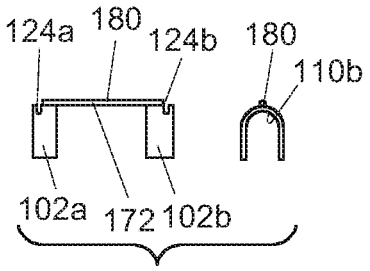
Fig. 11
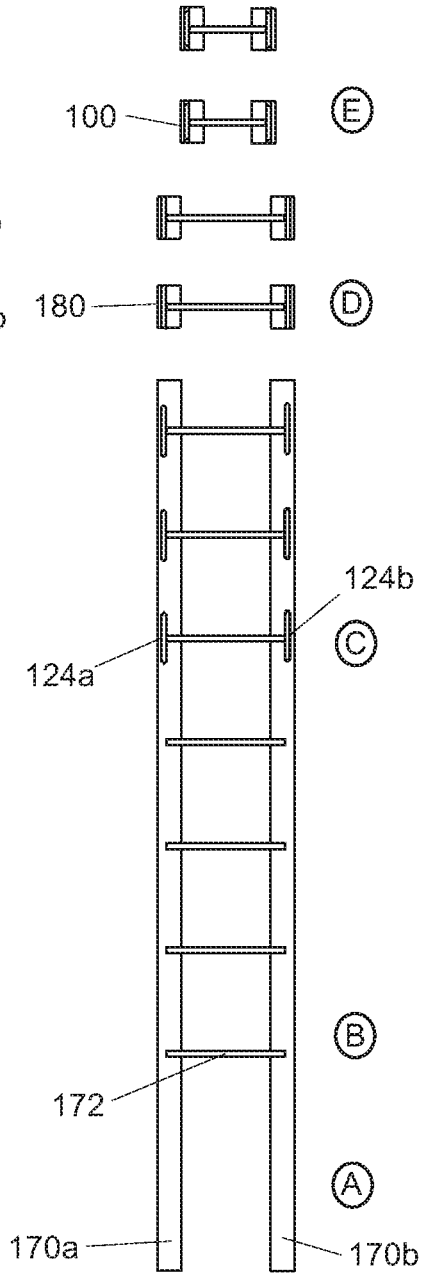
Fig. 9
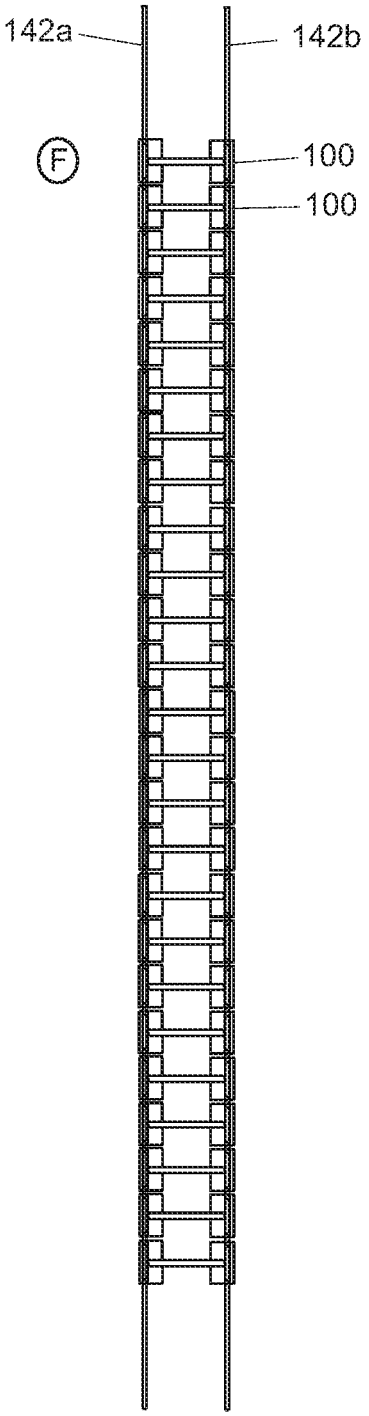
Fig. 10

Fig. 13
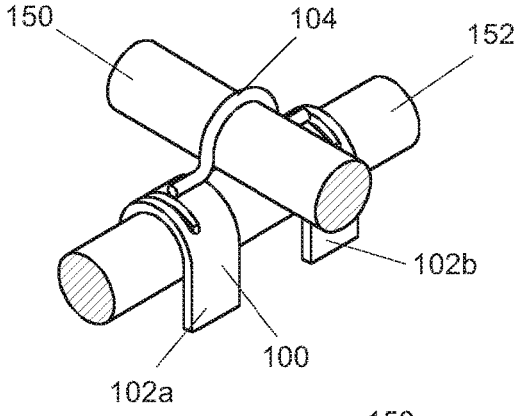
Fig. 14
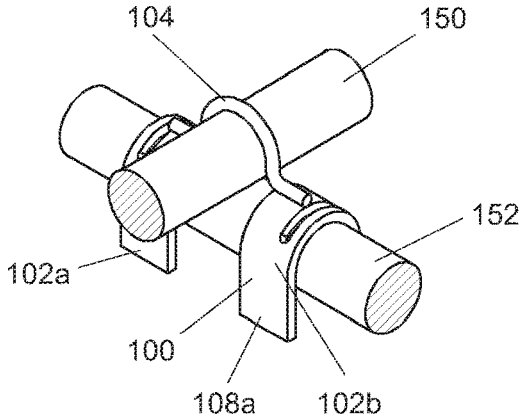
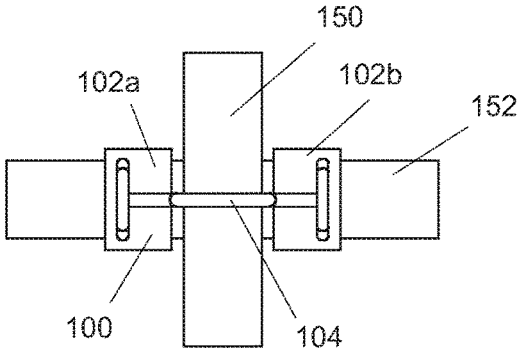
Fig. 15
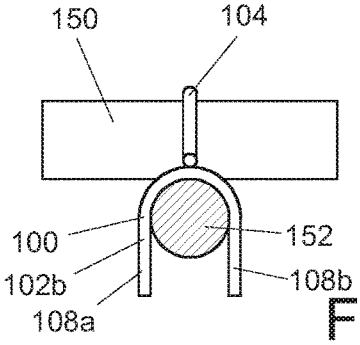
Fig. 17
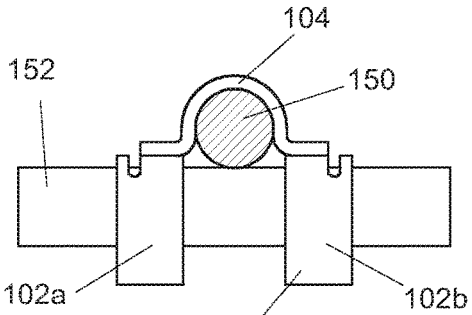
Fig. 16
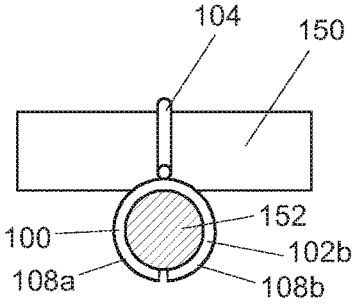
Fig. 18

Fig. 19
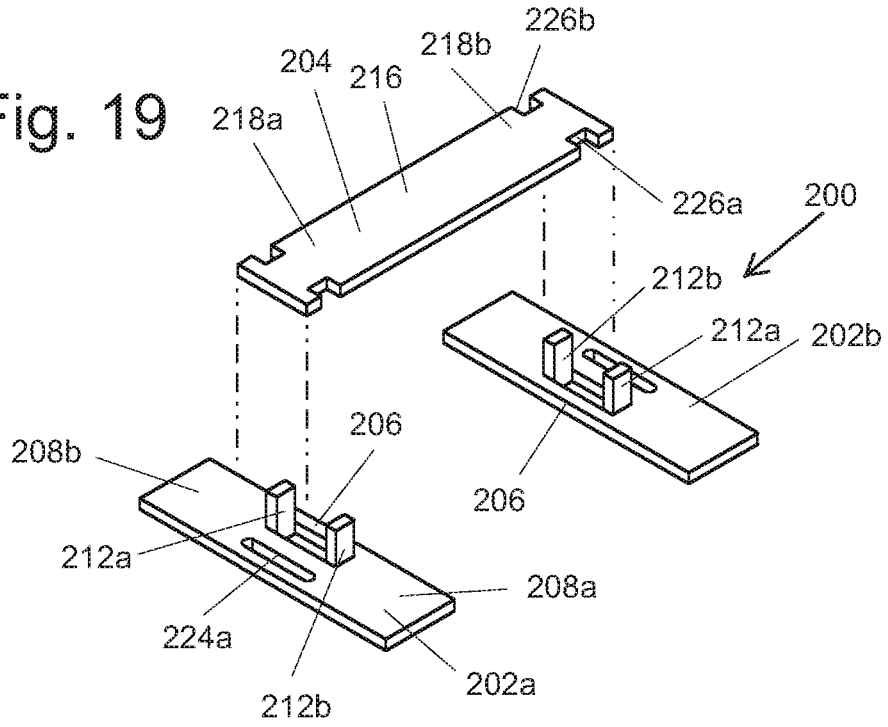
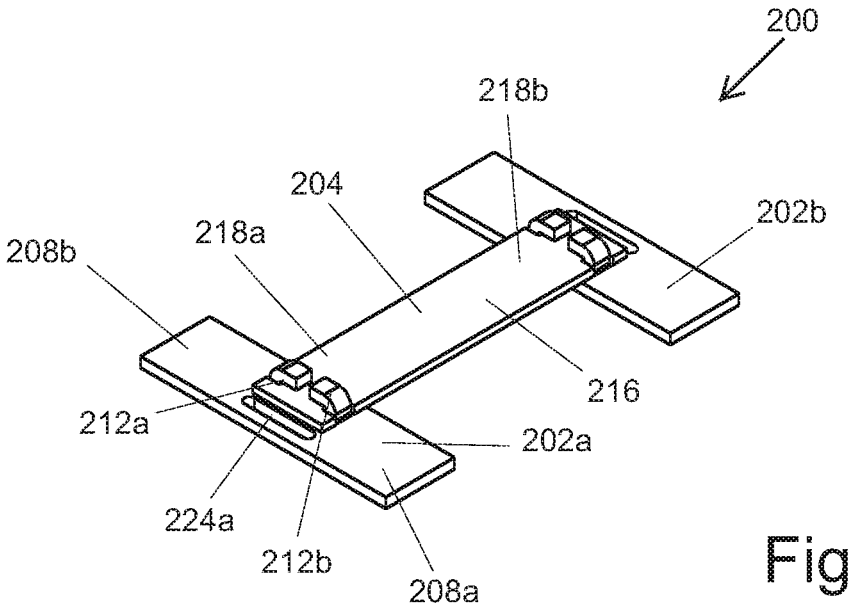
Fig. 20

Fig. 21
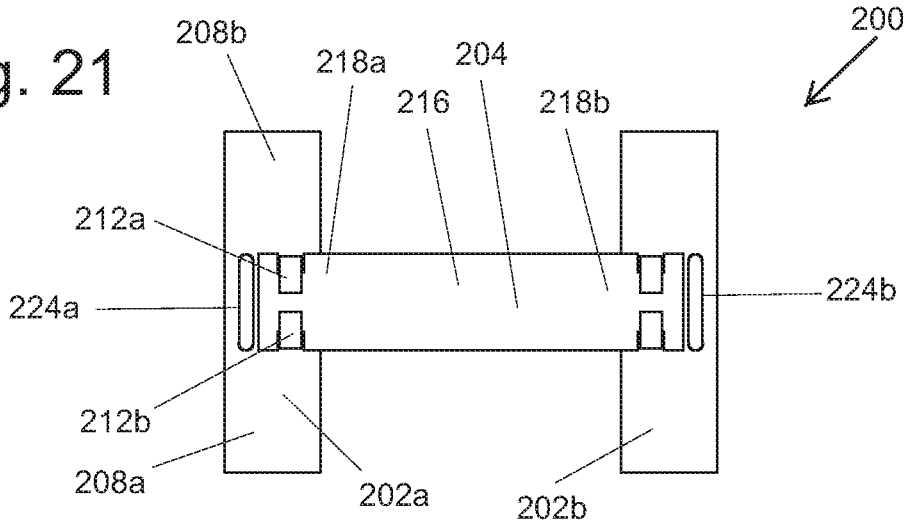
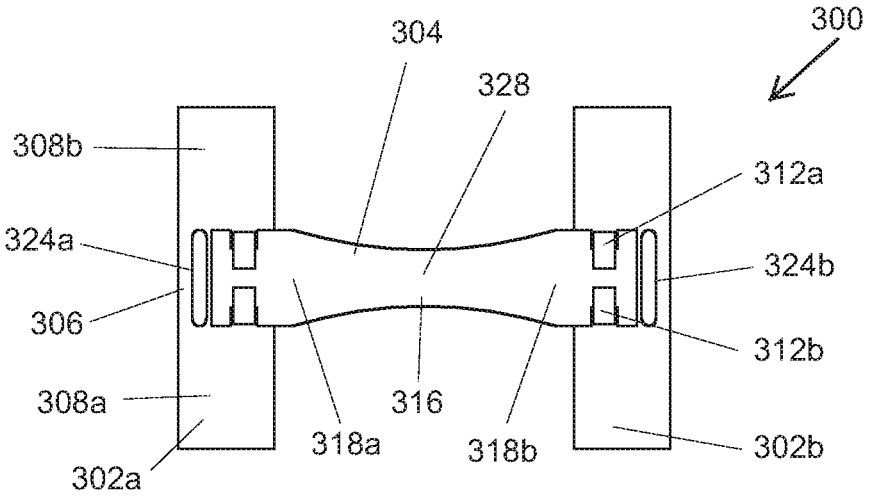
Fig. 22

Fig. 23
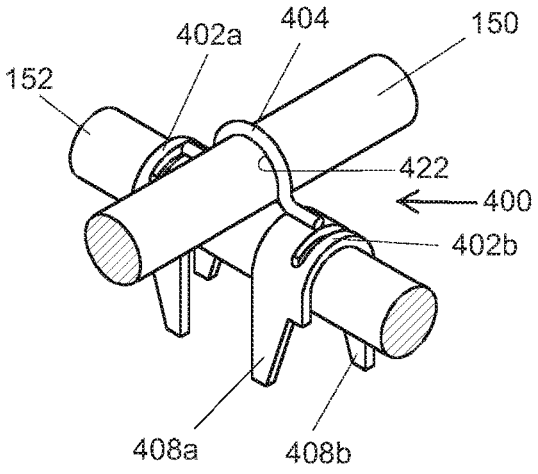
Fig. 24
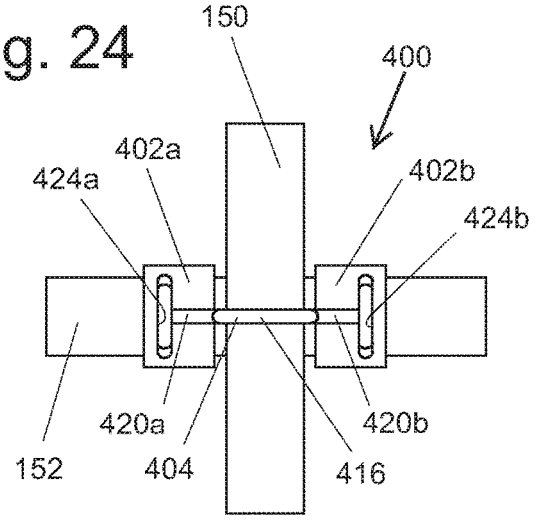
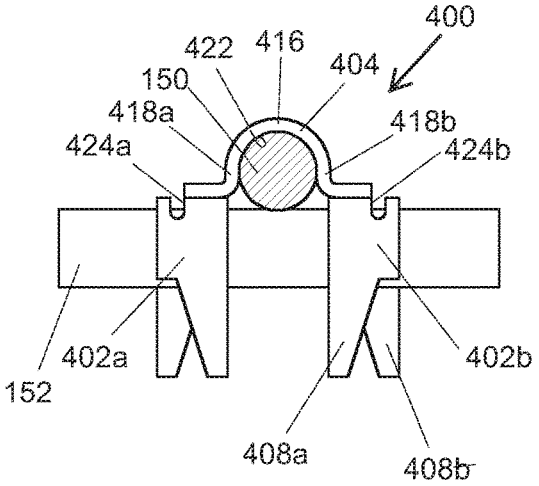
Fig. 25
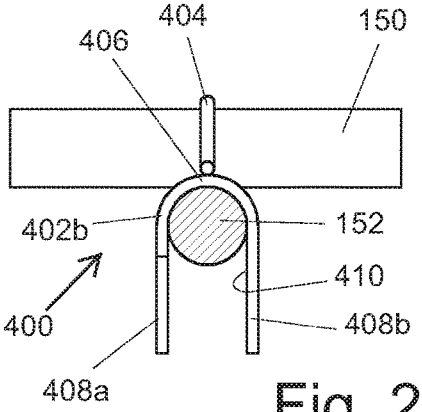
Fig. 26
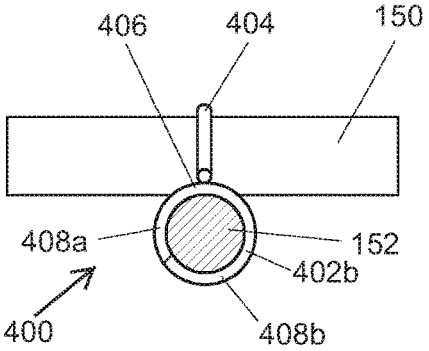
Fig. 27

Fig. 33
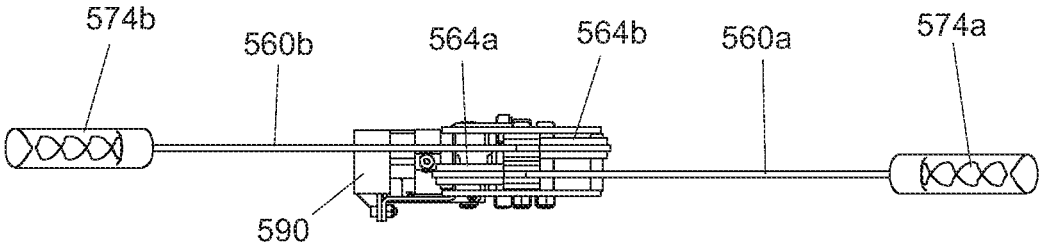
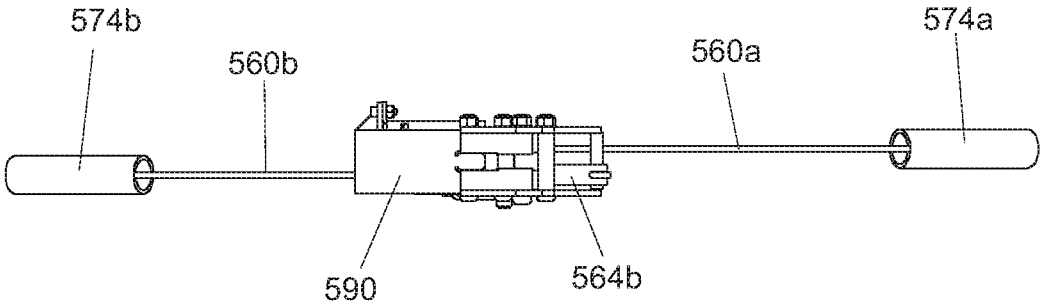
Fig. 34

COLLATED REBAR CLINCH CLIP

CROSS-REFERENCE TO RELATED APPLICATIONS

This application claims the benefit under 35 U.S.C. § 119(e) of U.S. Provisional Patent Application Ser. No. 63/020,536, filed May 5, 2020, the entire contents of which are incorporated herein by reference.

BACKGROUND OF THE INVENTION

Technical Field

The present invention relates to clips and, more particularly, to collated rebar clinch clips used for tying rebar together.

Background Art

Concrete is a composite material made of fine and coarse aggregate bonded together with a fluid cement. After being poured and over time, it hardens and cures into a stone-like substance.

Concrete is a convenient material used to construct roads, buildings, and other manmade structures. It is very strong in compression, but it is weak in tension as the concrete holding the aggregate together can crack allowing the structure to fail. To prevent this, steel reinforcing bars, or rebar, is placed within the concrete during construction to add tensile strength and increase the tensile load that can be carried. Rebar is supplied as long, thick wires or rods and is usually arranged horizontally or vertically in a grid or matrix pattern to form a flat mat or curtain, or in a three-dimensional cage. Before concrete is poured over the rebar to encase it, the lengths of transversely intersecting rebar are joined together by short lengths of thin steel wire that is wrapped around the joints to hold the rebar fixedly together preventing their relative movement. This is typically done manually and is a costly and backbreaking operation. It requires a worker to carry a wire reel or a supply of short wires and to constantly bend over while twisting the wires around the rebar with pliers or some other tool.

While integrally-formed, H-shaped clips that may be used to tie the rebar together could be punched out of thin, flat stock material, the manufacture of such clips does not lend itself to efficient configurations and would create significant amounts of waste.

BRIEF SUMMARY OF THE INVENTION

The present invention is directed to overcoming one or more of the problems as set forth above.

In accordance with the invention, many of the problems associated with time-consuming, backbreaking labor while tying rebar together are avoided by providing collated rebar clinch clips and a crimping tool with a magazine to hold the clips.

The devices disclosed herein provide an effective means for tying lengths of rebar together that is quicker, less costly, and makes for a tighter connection.

In one aspect of the invention, a rebar clinch clip is constructed with three basic components, namely, a U-shaped bridge element overlying a first rebar and a pair of spaced U-shaped crimp elements fixed to the ends of the bridge element and overlying a second rebar that underlies and is orthogonal to the first rebar. In accordance with the invention, a collated series of clips is provided that may be loaded into a magazine that feeds a crimping tool operable by a worker.

In one embodiment of the invention, the bridge element is a U-shaped wire welded to the end sections.

In another embodiment of the invention, the bridge element is a strip mechanically joined to the crimp elements.

A feature of the invention are severable flexible cords connecting a series of clips together and slots formed in the crimp elements for receiving the cords that may be closed to hold the cords within the slots and thereby to the clips.

In accordance with the invention, a clip crimping tool includes a frame, an anvil, a blade, a magazine to feed collated clips between the anvil and blade, and an actuator to move the blade and anvil together to crimp a clip around rebar placed between the blade and anvil.

A feature of the invention is that the actuator includes a handle spaced from the blade and anvil such that a worker may operate the tool standing upright without bending over when the intersecting rebar to be joined is located at the worker's feet.

BRIEF DESCRIPTION OF THE SEVERAL VIEWS OF THE DRAWINGS

The details of construction and operation of the invention are more fully described with reference to the accompanying drawings which form a part hereof and in which like reference numerals refer to like parts throughout.

In the drawings:

FIG. 9 is a schematic diagram showing the steps in forming a rebar clinch clips shown in FIG. 1;

FIG. 10 is a schematic diagram showing the rebar clinch clips as formed in FIG. 9 joined by a pair of connecting cords to form a collated length of clips;

FIG. 11 shows front and end elevational views of a clip after the legs are formed and the clip sheared from upstream material as shown in FIG. 9 at position D;

FIG. 12 shows front and end elevational views of a clip after the center bridge element is formed as shown in FIG. 9 at position E;

FIG. 13 is a top perspective view of the rebar clinch clip shown in FIG. 1 positioned over the junction of two rebars prior to being crimped tight;

FIG. 14 is another top perspective view of the rebar clinch clip shown in FIG. 13 positioned over the junction of two rebars prior to being crimped tight;

FIG. 15 is a top plan view of the rebar clinch clip shown in FIG. 13 positioned over the junction of two rebars prior to being crimped tight;

FIG. 16 is a front elevational view of the rebar clinch clip shown in FIG. 13 positioned over the junction of two rebars prior to being crimped tight;

FIG. 17 is a side elevational view of the rebar clinch clip shown in FIG. 13 positioned over the junction of two rebars prior to being crimped tight;

FIG. 18 is a side elevational view similar to FIG. 17 of the rebar clinch clip positioned over the junction of two rebars after being crimped;

FIG. 19 is an exploded top perspective view of a second embodiment of a rebar clinch clip constructed in accordance with the disclosure herein;

FIG. 20 is a top perspective view of the rebar clinch clip shown in FIG. 19 after assembly prior to forming of the arched bridge element and U-shaped crimp elements;

FIG. 21 is a top plan view of the rebar clinch clip shown in FIG. 19 after assembly prior to forming of the arched bridge element and U-shaped crimp elements;

FIG. 22 is a top plan view of a third embodiment of a rebar clinch clop constructed in accordance with the disclosure prior to forming of the arched bridge element and U-shaped crimp elements;

FIG. 23 is a top perspective view of a fourth embodiment of a rebar clinch clip constructed in accordance with the disclosure herein positioned over the junction of two rebars prior to being crimped tight;

FIG. 24 is a top plan view of the rebar clinch clip shown in FIG. 23 positioned over the junction of two rebars prior to being crimped tight;

FIG. 25 is a front elevational view of the rebar clinch clip shown in FIG. 23 positioned over the junction of two rebars prior to being crimped tight;

FIG. 26 is a side elevational view of the rebar clinch clip shown in FIG. 23 positioned over the junction of two rebars prior to being crimped tight;

FIG. 27 is a side elevational view similar to FIG. 26 of the rebar clinch clip positioned over the junction of two rebars after being crimped tight around the lower rebar with the clip legs bypassing one another;

FIG. 33 is a top plan view of the crimping tool shown in FIG. 28;

FIG. 34 is a bottom plan view of the crimping tool shown in FIG. 28;

Figure 1:
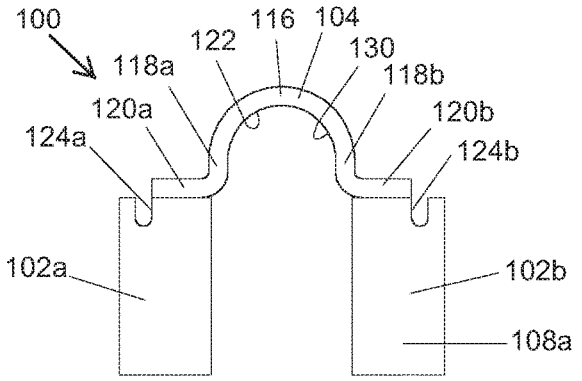
FIG. 1 is a front elevational of a first embodiment of a single rebar clinch clip constructed in accordance with the disclosure herein.
Figure 4:
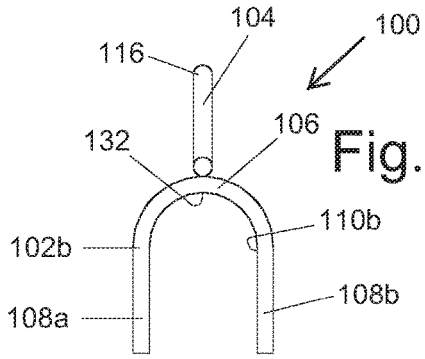
FIG. 4 is a side elevational view of the rebar clinch clip shown in FIG. 1.
Figure 2:
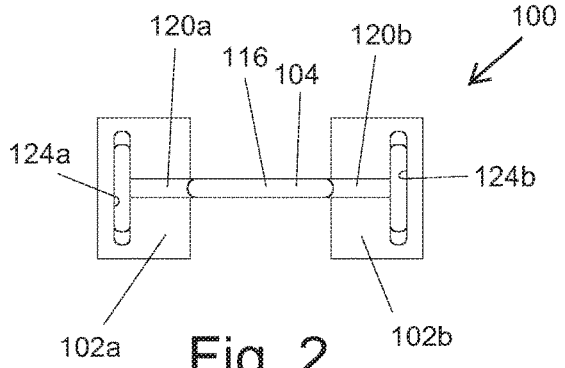
FIG. 2 is a top plan view of the rebar clinch clip shown in FIG. 1.
Figure 5:
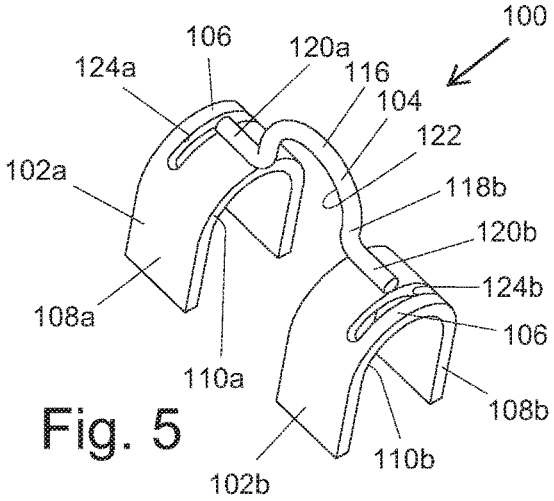
FIG. 5 is a top perspective view of the rebar clinch clip shown in FIG. 1.
Figure 3:
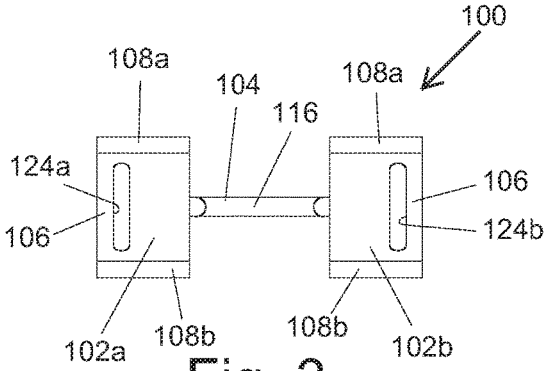
FIG. 3 is a bottom plan view of the rebar clinch clip shown in FIG. 1.
Figure 6:
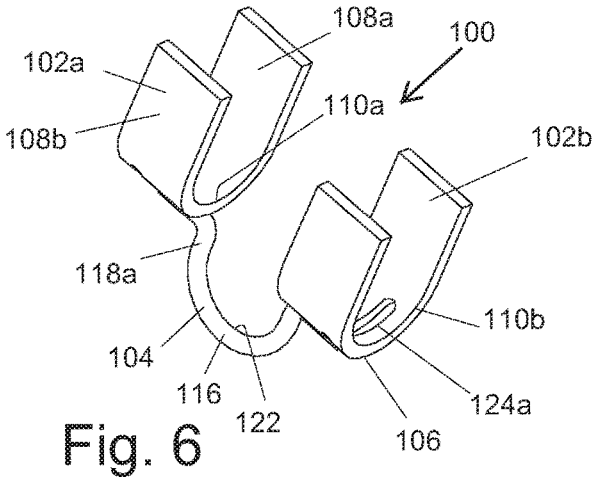
FIG. 6 is a bottom perspective view of the rebar clinch clip shown in FIG. 1.

All figures are drawn for ease of explanation of the basic teachings of the present invention only; the extensions of the figures with respect to number, position, relationship, and dimensions of the parts to form the preferred embodiment will be explained or will be within the skill of the art after the following teachings of the present invention have been read and understood.

DETAILED DESCRIPTION OF THE PREFERRED EMBODIMENTS

While the present invention is susceptible of embodiment in many different forms, there are shown in the drawings and will be described herein in detail specific embodiments thereof with the understanding that the present disclosure is to be considered as an exemplification of the principles of the invention and is not intended to limit the invention to the specific embodiments illustrated.

Collated Rebar Clinch Clips

In FIGS. 1-18, a first embodiment of a collated rebar clinch clip, generally designated 100, for fixing two lengths of rebar together is shown. As best seen in FIGS. 13-18, the clip 100 is positioned over two lengths rebar, a longitudinally-extending upper rebar 150 and an underlying laterally-extending lower rebar 152 orthogonal to and abutting the bottom of the upper rebar 150.

As seen in FIGS. 1-6, an individual clip 100, which may be made of low carbon steel, has three components, namely, a pair of crimp elements 102*a*,102*b* and an arched bridge element 104, connecting the crimp elements 102*a*,102*b* that are located below in laterally spaced relation.

Each of the crimp elements 102*a*,102*b* is a U-shaped strip having a center bight portion 106 and a pair of parallel downwardly-extending legs 108*a*,108*b*. The legs 108*a*,108*b* of the crimp elements 102*a*,102*b* define a pair of aligned, laterally-extending openings 110*a*,110*b* through which the lower rebar 152 extends. The bight portions 106 of the crimp elements 102*a*,102*b* are arcuate, but may have a polygonal shape or any other suitable configuration. The crimp elements 102*a*,102*b* have a rectangular cross-section.

The bridge element 104 is a U-shaped wire having a center arched bight portion 116 and a pair of parallel downwardly-extending arms 118*a*,118*b* with fingers 120*a*, 120*b* extending laterally outward. The bridge fingers 120*a*, 120*b* overlap and fixed to the top surface of the bight portion 106 of the crimp elements 102*a*,102*b* by attachment means, such as by welding or by any suitable mechanical connection. The arms 118*a*,118*b* of the bridge element 104 define an opening 122 that is orthogonal to openings 110*a*,110*b* and through which the upper rebar 150 extends. Similar to the crimp elements 102*a*,102*b*, the bridge bight portion 116 is arcuate, but may have a polygonal shape or any other suitable cross-sectional configuration. The bridge element 104 has a circular cross-section.

Intermediate the lateral ends of the bridge fingers 120*a*, 120*b* and the outward edge of each crimp element 102*a*, 102*b* are longitudinal slots 124*a*,124*b*. As will be apparent later, the slots 124*a*,124*b* have a size and configuration such that when the crimp elements 102*a*,102*b* are formed with the bight portions 106 being bent, the slots 124*a*,124*b* will be upwardly opening and have a depth allowing a collating cord to be positioned therein as seen in FIGS. 7-8.

The diameter of the bight portion 116 of the bridge element 104 and the vertical distance between the lower surface 130 of the bridge bight portion 116 and the lower surface 132 of the crimp element bight portion 106 have a dimension slightly larger than the diameter of the upper rebar 150. The diameter of the bight portion 106 of the crimp elements 102*a*,102*b* is slightly larger than the diameter of the lower rebar 152. The height of the crimp element legs 108*a*,108*b* is of a length permitting the legs to wrap around the bottom of the rebar 152 as seen in FIG. 18.

Figure 8:
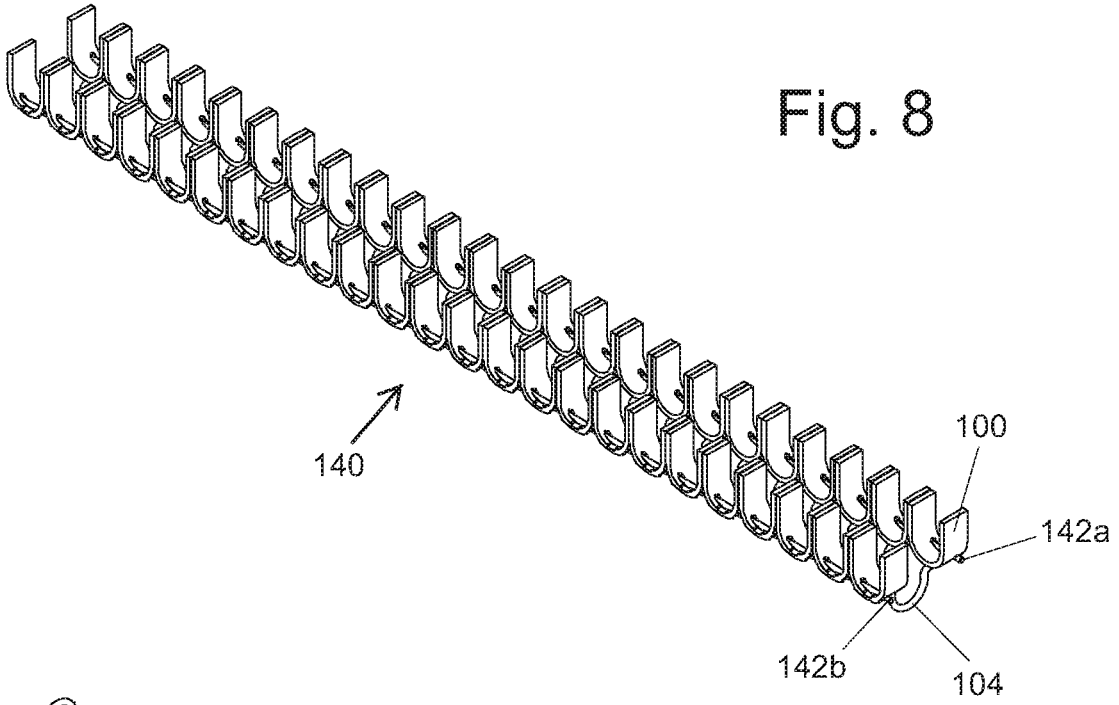
FIG. 8 is a bottom perspective view of a collated series of rebar clinch clips shown in FIG. 1.
Figure 7:
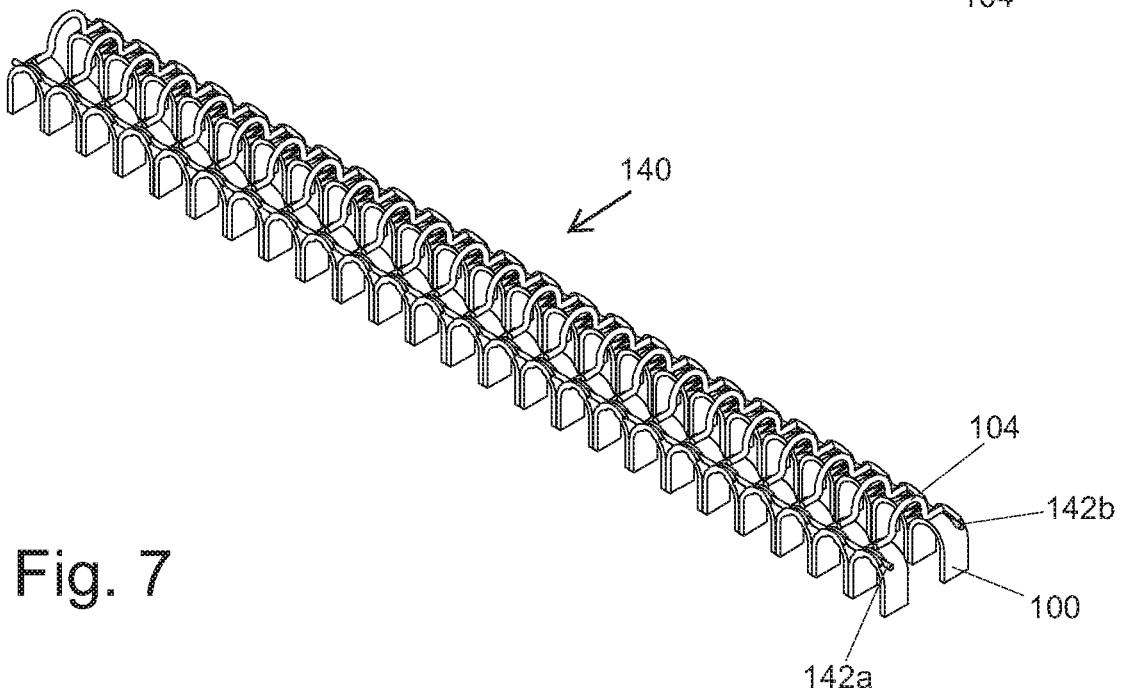
FIG. 7 is a top perspective view of a collated series of rebar clinch clips shown in FIG. 1.
Figure 28:
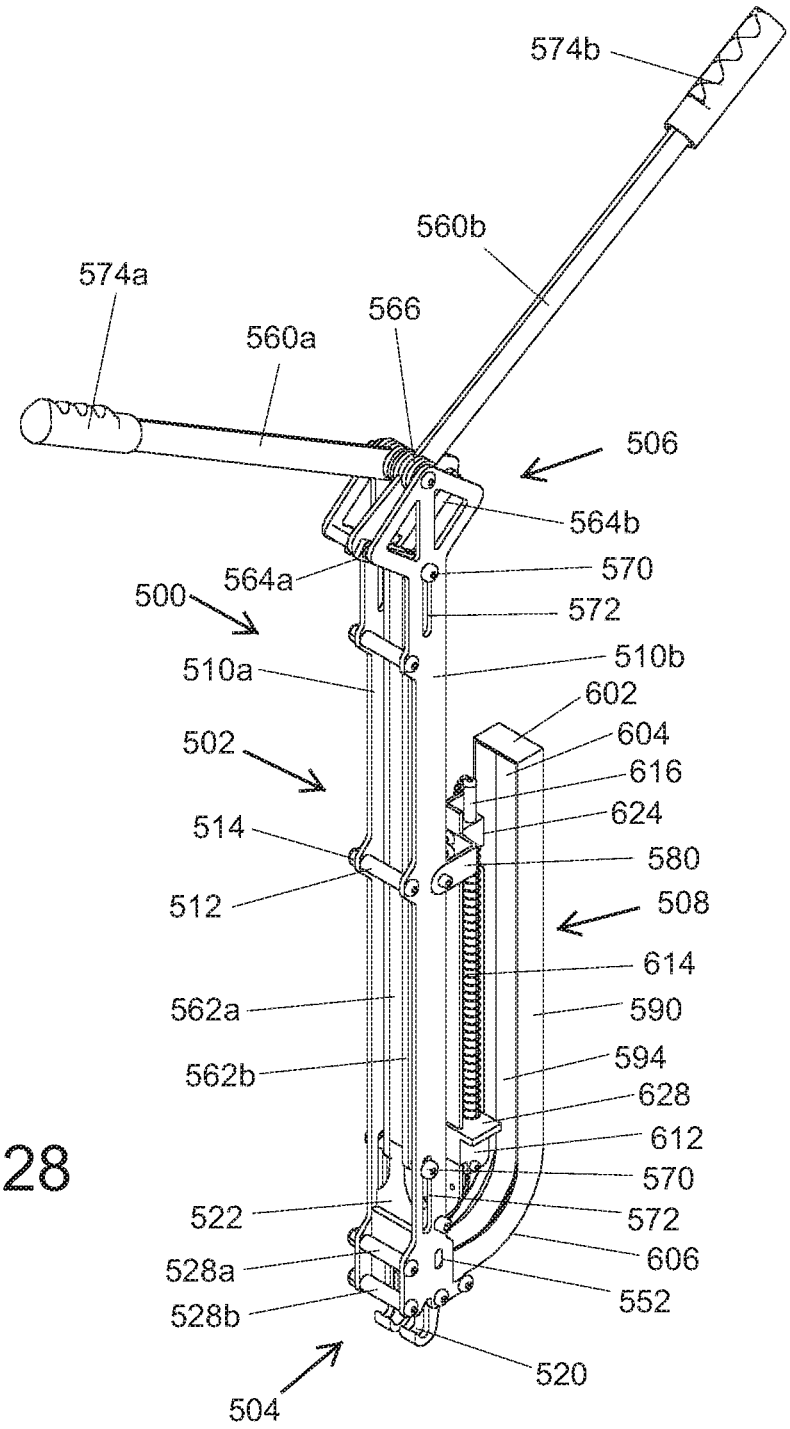
FIG. 28 is a perspective view of a crimping tool employed to apply rebar clinch clips disclosed herein.
Figure 29:
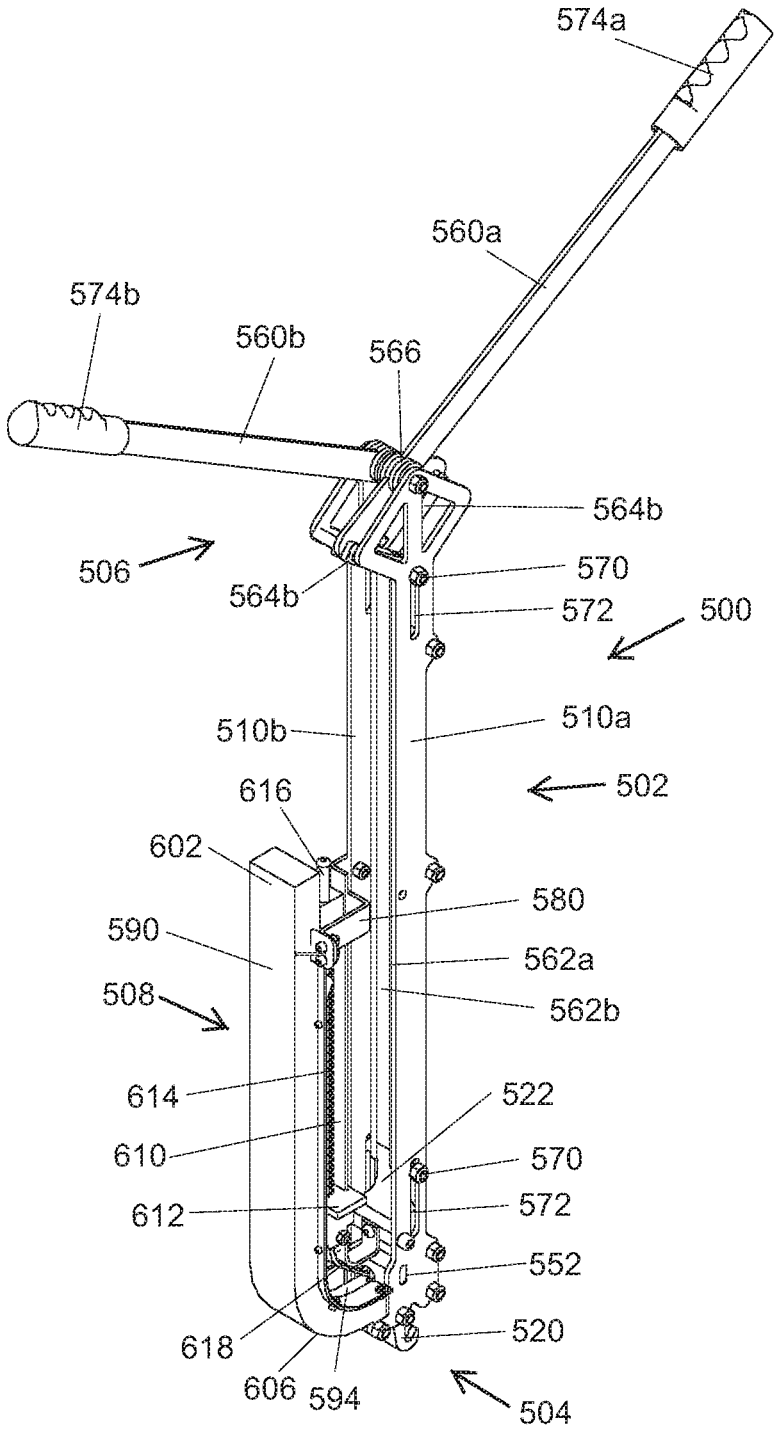
FIG. 29 is another perspective view of the crimping tool shown in FIG. 28.
Figure 30:
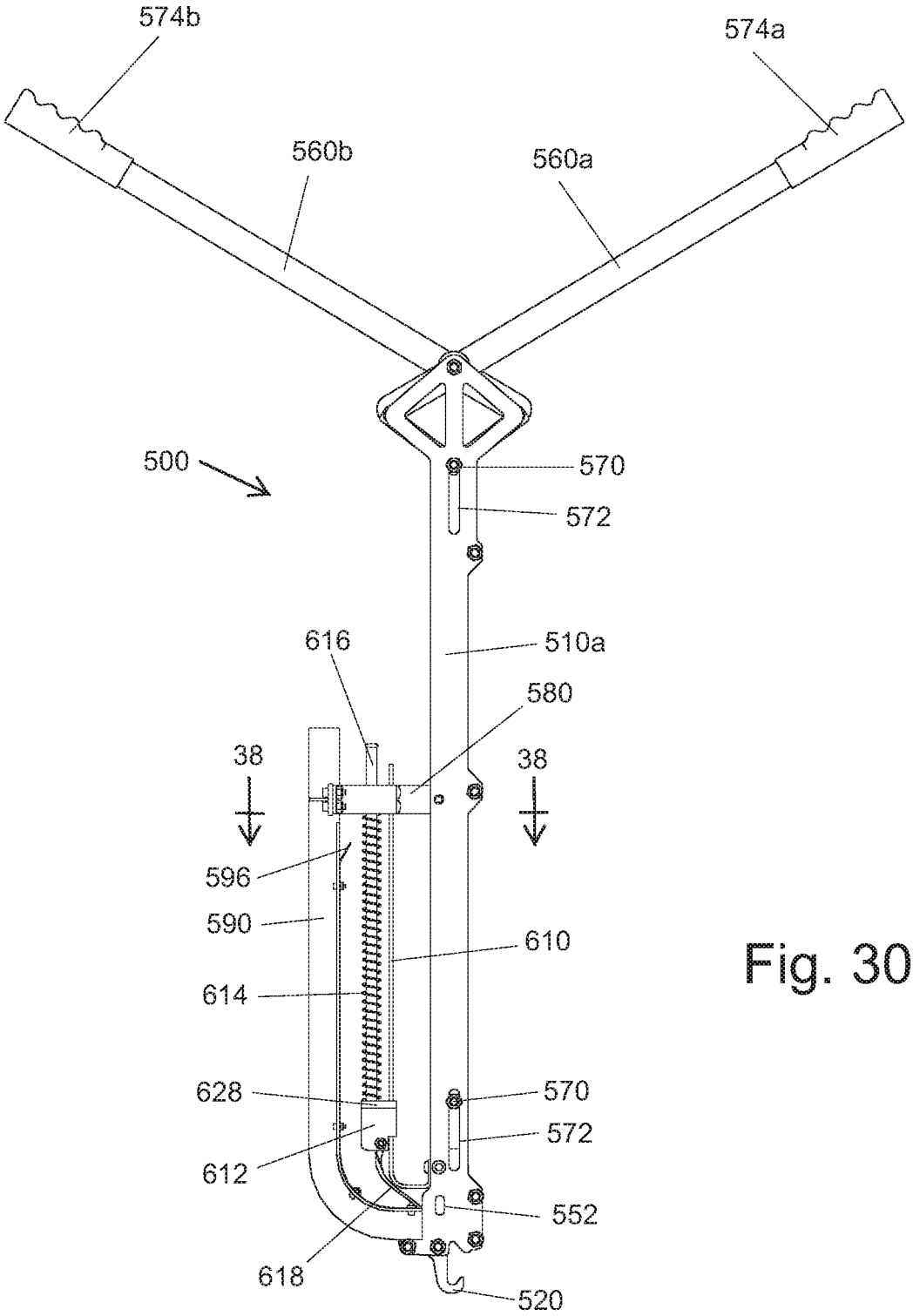
FIG. 30 is a side elevational view of the crimping tool shown in FIG. 28.
Figure 31:
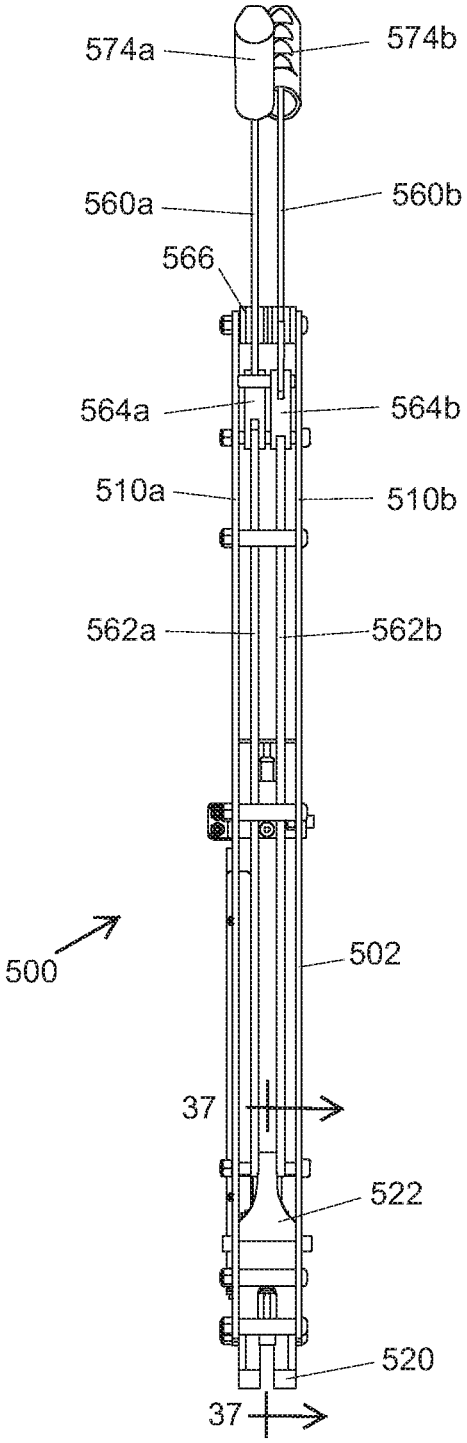
FIG. 31 is a front elevational view of the crimping tool shown in FIG. 28.
Figure 32:
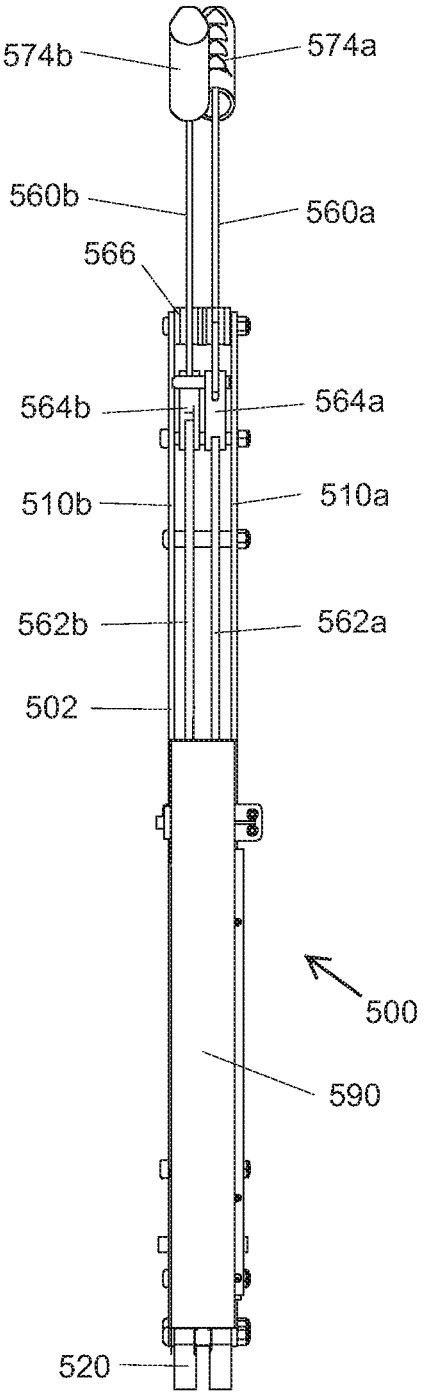
FIG. 32 is a rear elevational view of the crimping tool shown in FIG. 28.
Figure 35:
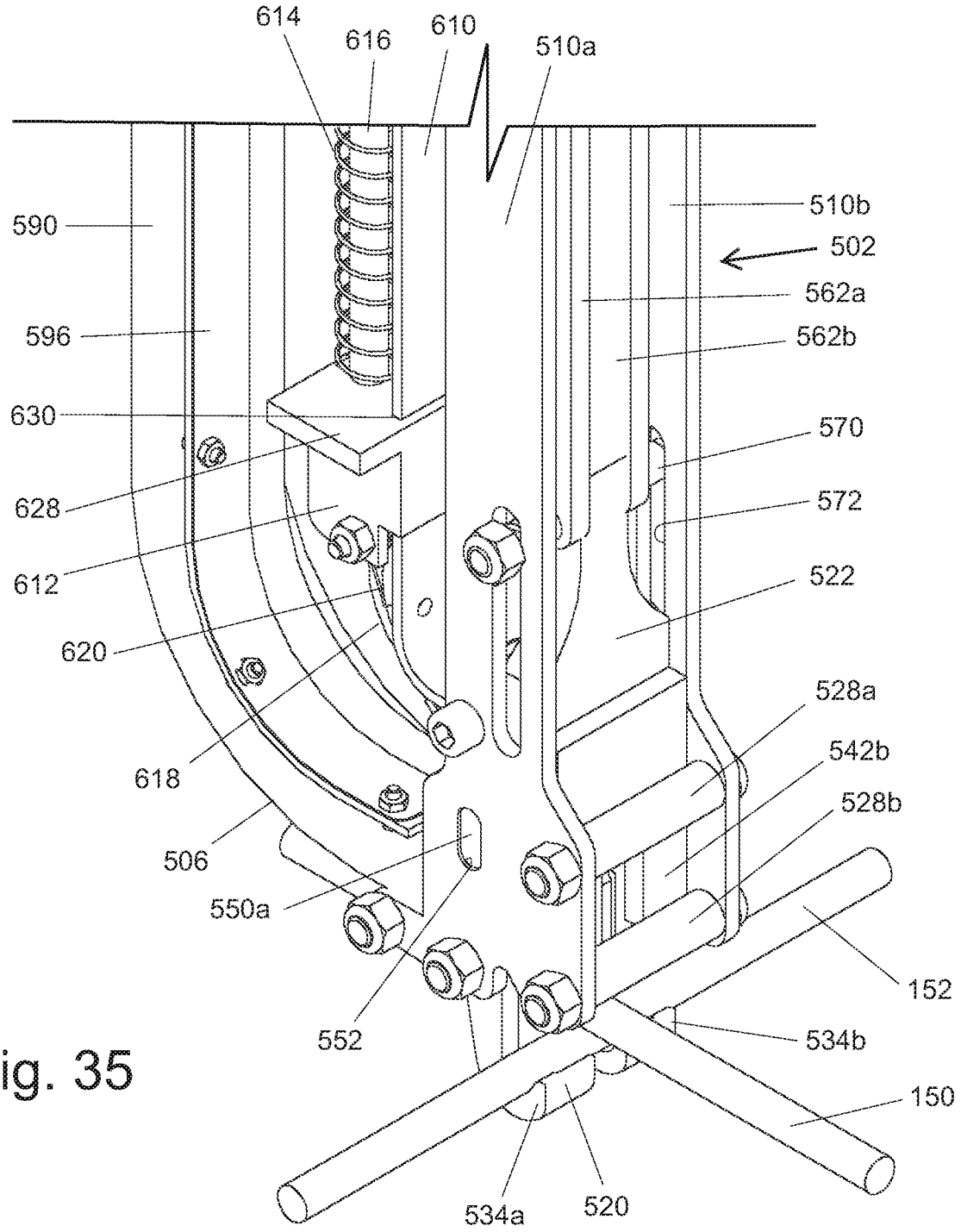
FIG. 35 is an enlarged, partial, perspective view of the lower portion of the crimping tool shown in FIG. 28 with two rebars positioned within the crimping tool.
Figure 36:
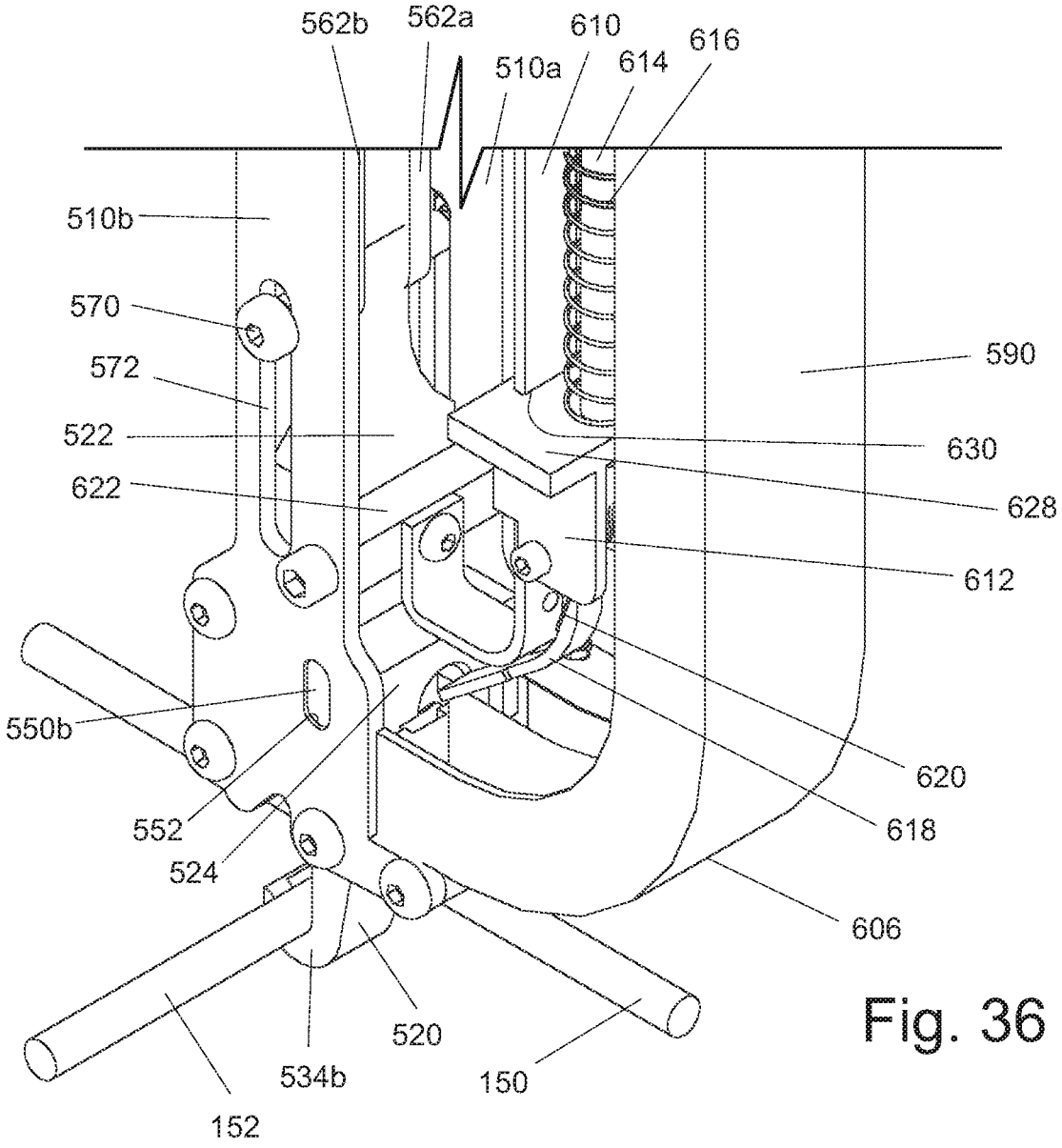
FIG. 36 is another enlarged, partial, perspective view of the lower portion of the crimping tool shown in FIG. 28 with two rebars positioned within the crimping tool.
Figure 37:
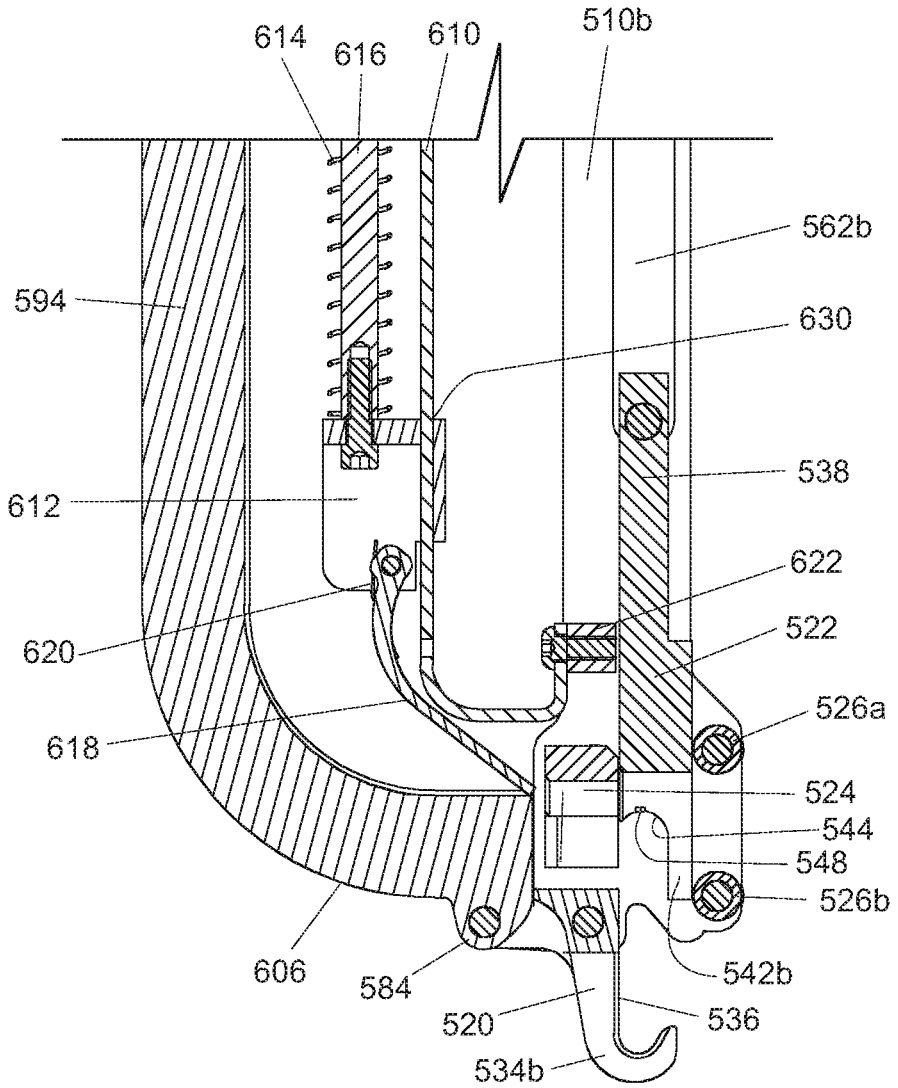
FIG. 37 is an enlarged cross-sectional view of the lower portion of the crimping tool taken along line 37-37 in FIG. 31.
Figure 38:
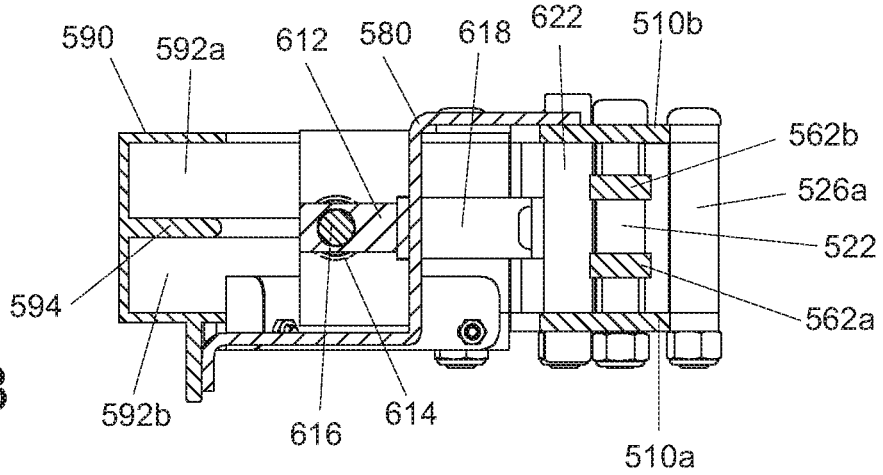
FIG. 38 is an enlarged cross-sectional view of the lower portion of the crimping tool taken along line 38-38 in FIG. 30.
Figure 39:
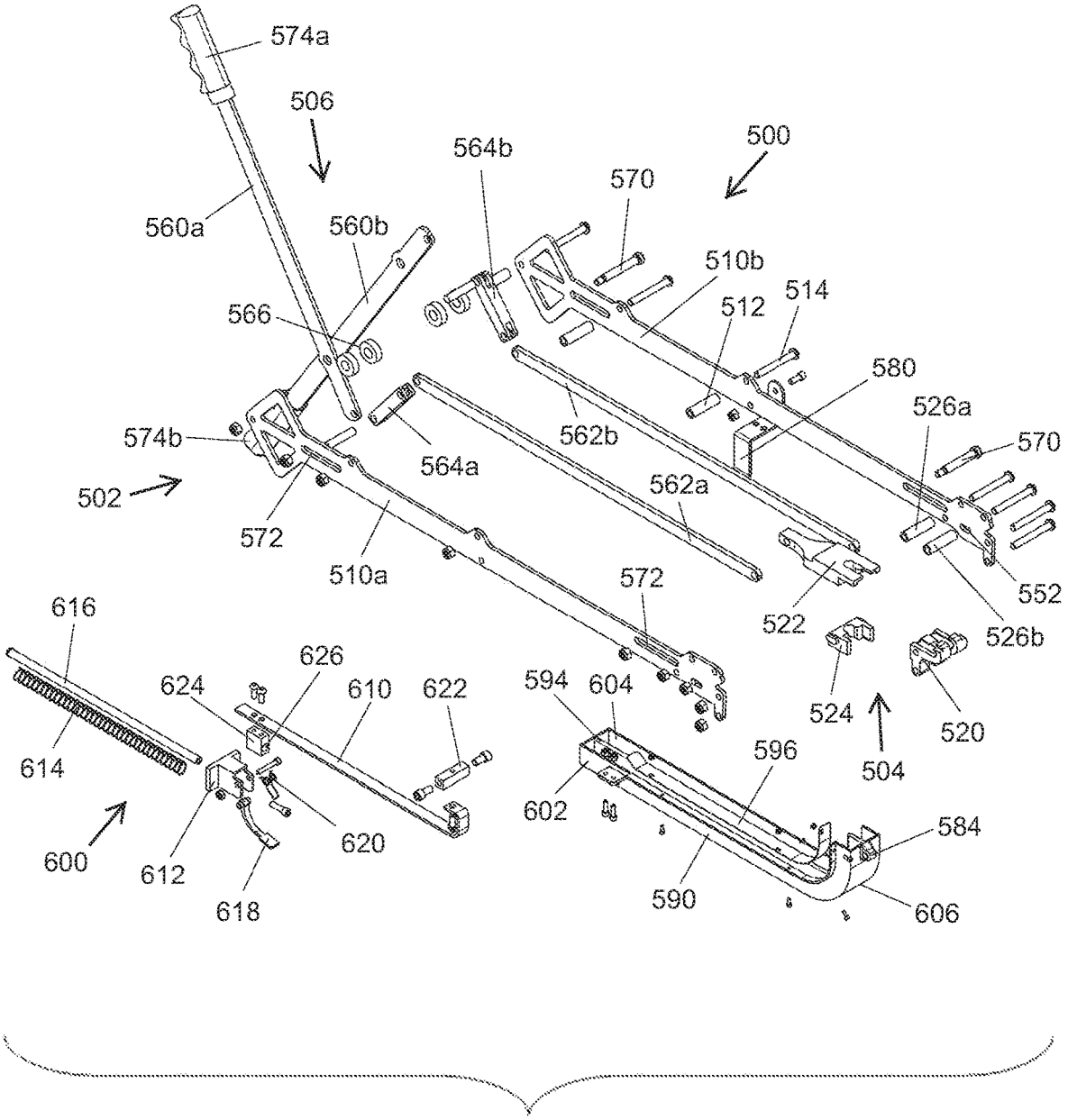
FIG. 39 is an exploded view of the crimping tool shown in FIG. 28.

As seen in FIGS. 7 and 8, a plurality of clinch clips 100 are collated into a connected side-to-side series, generally designated 140, by means of a pair of parallel thin polyethylene cords 142*a*,142*b*. Each clip 100 is mechanically attached to the cords 142*a*,142*b* by compressing the sides of the open slots 124*a*,124*b* inward to close them slightly thereby holding the cords 142*a*,142*b* and fixing the clip 100 in position along the cords 136*a*,136*b*. The relatively thin cords 142*a*,142*b* are easily severed to separate individual clips when they are later attached to the lengths of rebar.

FIGS. 13-18 show the clip 100 without the collating cords in position on two orthogonally-oriented rebars 150,152. FIGS. 13-17 show an open clip 100 with the bridge element 104 overlying and resting on the upper rebar 150 and the crimp elements 102*a*,102*b* resting on and overlying the lower rebar 152 on either lateral side of the upper rebar 150. FIG. 18 shows a clip 100 with the legs 108*a*,108*b* of the crimp elements 102*a*,102*b* deformed to hold the clip 100 on the lower rebar 152 and thereby hold both the upper rebar 150 and lower rebar 152 in fixed relation.

As seen, the clinch clip 100 is formed from three separate components, namely, the crimp elements 102*a*,102*b* and the bridge element 104. The parallel crimp elements 102*a*,102*b* are spaced along the rebar 152 and have an arcuate connecting bight portion 106 overlying the rebar 152. The bight portion 116 connects the ends of the two spaced parallel legs 108*a*,108*b* to define U-spaced openings 110*a*,110*b* orthogonal to the lower rebar 152 having a dimension allowing fitment over the rebar 152 that extends in one direction.

The bridge element 104 has an arcuate bight portion 116 overlying the rebar 150 and connects the crimp elements 102*a*,102*b* together. The arcuate bight portion 116 connects the ends of the two spaced parallel arms 118*a*,118*b* to define U-shaped opening 122 orthogonal to the upper rebar 150 having a dimension allowing fitment over the rebar 150 that extends in a second direction.

To form a complete clip, the metal crimp elements 102*a*, 102*b* are fused as by welding to the bridge fingers 120*a*,120*b* extending outward and overlapping the bight portions 106 of the crimp elements 102*a*,102*b*. To bind two transverse or orthogonal rebars together, the clip 100 is placed over the rebars 150,152 with the legs 108*a*,108*b* of the crimp elements 102*a*,102*b* being forcefully deformed to at least partially wrap around the lower rebar. For round rebar, the arcuate bight portions have a semicircular shape.

FIGS. 19-21 show a second embodiment of a rebar clinch clip prior to forming. The clip, generally designated 200, has three components, namely, a pair of crimp elements 202*a*, 202*b* and a bridge element 204 connecting the crimp elements 202*a*,202*b* that are located in laterally spaced relation. The crimp elements 202*a*,202*b* and the bridge element 204 are formed from metal, such as steel, and have a rectangular cross-section.

Each of the crimp elements 202*a*,202*b* is a strip having a center portion 206 and a pair of legs 208*a*,208*b* extending outwardly therefrom. The legs 208*a*,208*b* of the crimp elements 202*a*,202*b* when formed define a pair of aligned, laterally-extending openings through which the lower rebar 152 will extend. Formed in the center portion 206 of each crimp element 202*a*,202*b* is a pair of spaced, upright prongs 212*a*,212*b* space inward from one edge and slots 224*a*,224*b* intermediate the prongs 212*a*,212*b* and the opposite edge.

The bridge element 204 is a bar having a center portion 216 and arms 218*a*,218*b* extending outwardly therefrom. The arms 218*a*,218*b* of the bridge element 204 when formed define a longitudinally-extending opening through which the upper rebar 150 will extend.

The bridge element 204 has a pair of opposed cutouts 226*a*,226*b* along each longitudinal edge spaced inwardly from lateral edges. The clip 200 is fixedly assembled by placing the bridge element 204 over the crimp elements 202*a*,202*b* by positioning the prongs 212*a*,212*b* within the respective cutouts 226*a*,226*b* and then bending the prongs 212*a*,212*b* inwardly down over the top of the bridge element 204 to mechanically attach crimp elements to the overlapping bridge. Slots 224*a*,224*b* are formed in each of the crimp elements 202*a*,202*b* intermediate the lateral ends of the bridge element 204 and the outward edge of each crimp element 202*a*,202*b*.

FIG. 22 shows a third embodiment of a rebar clinch clip prior to shaping of the clip elements into U-shaped forms. The clip, generally designated 300, has three components, namely, a pair of crimp elements 302*a*,302*b* and a bridge element 304 connecting the crimp elements 302*a*,302*b* that are located in laterally spaced relation. The crimp elements 302*a*,302*b* and the bridge element 304 are formed from metal, such as steel, and have a rectangular cross-section.

Each of the crimp elements 302*a*,302*b* is a strip having a center portion 306 and a pair of legs 308*a*,308*b* extending outwardly therefrom. The legs 308*a*,308*b* of the crimp elements 302*a*,302*b* when formed define a pair of aligned, laterally-extending openings through which the lower rebar 152 will extend. Formed in the center portion 306 of each crimp element 302*a*,302*b* is a pair of spaced prongs 312*a*, 312*b* spaced inward from one edge and a slot 324 intermediate the prongs 312*a*,312*b* and the opposite edge.

The bridge element 304 is a bar having a center portion 316 and arms 318*a*,318*b* extending outwardly therefrom. The arms 318*a*,318*b* of the bridge element 304 when formed define a longitudinally-extending opening 322 through which the upper rebar 150 will extend. The edges of the center portion 316 are curved inwardly defining a narrow segment 328 so that when collated clips are coiled the upright bridges of adjacent clips are not in interference and the clips may overlap one another.

The bridge element 304 has a pair of opposed cutouts along each longitudinal edge spaced inwardly from lateral edges. The clip 300 is fixedly assembled by placing the bridge element 304 over the crimp elements 302*a*,302*b* by positioning the prongs 312*a*,312*b* within the respective cutouts and then bending the prongs 312*a*,312*b* inwardly down over the top of the bridge element 304. Formed in each of the crimp elements intermediate the lateral ends of the bridge element 304 and the outward edge of each crimp elements are longitudinal slots 324*a*,324*b*.

FIGS. 23-27 show a fourth embodiment of a rebar clinch clip, generally designated 400, having three components, namely, a pair of crimp elements 402*a*,402*b* and an arched bridge element 404 connecting the crimp elements 402*a*, 402*b* that are located in laterally spaced relation. The crimp element s402*a*,402*b* and the bridge element 404 are formed from metal, such as steel, and have a rectangular cross-section.

Each of the crimp elements 402*a*,402*b* is a U-shaped strip having a center bight portion 406 and a pair of downwardly extending legs 408*a*,408*b* having a straight edge and a tapering edge. It will be understood that when the legs 408*a*,408*b* are severed from the continuous strip of raw material by cutting at an angle, one side of a leg 408*a*,408*b* is complementary to the other side of a preceding or succeeding leg thereby saving material and allowing for longer legs, if desired. The legs 408*a*,408*b* of the crimp elements 402*a*,402*b* define a pair of aligned, laterally-extending openings 410 through which the lower rebar 152 extends. As been seen in FIG. 27, the legs 408*a*,408*b* are longer than those shown in FIGS. 1-26 so that they may be wrapped around the lower rebar 152 more completely without overlapping, since they will bypass one another so as to lie in side-by-side relation after crimping.

The bridge element 404 is a U-shaped wire having a center bight portion 416 and downwardly extending arms 418*a*,418*b* with fingers 420*a*,420*b* extending laterally outward. The bridge fingers 420*a*,420*b* are fixed to the top surface of the crimp elements 402*a*,402*b* by any suitable means. The arms 418*a*,418*b* of the bridge element 404 define a longitudinally-extending opening 422 through which the upper rebar 150 extends.

Intermediate the ends of the bridge fingers 420*a*,420*b* and the outward edge of each crimp elements 402*a*,402*b* are longitudinal slots 424*a*,424*b* having a size and configuration such that when the crimp elements 402*a*,402*b* are formed with the bight portion 406 being bent, the slots 424*a*,424*b* will be upwardly opening and have a depth allowing a collating cord to be positioned and held therein.

Method of Manufacturing Collated Rebar Clinch Clips

As illustrated in development in FIGS. 9-12, completed clips 100 are formed in stages on a punch press with a progressive die (not shown). As is well known, such a press with properly constructed dies can perform punching, perforating, slitting, severing, bending, swaging, stamping and other operations. Usually, these operations are done on long strips, ribbons or webs of coiled, relatively thin, metal stock that is unrolled, flattened, fed into the press, and advanced in predetermined pitch increments during each press cycle.

In FIGS. 9-12, the stages of clip formation are shown. Typically, each stage, denoted by the letters A-F, takes place in a punch press as raw stock material is progressively indexed a predetermined distance through a series of die stations.

At the first station indicated at A, a pair of unformed thin metal blank strips 170*a*,170*b* are advanced into the press in spaced, parallel relation. When the inbound strips 170*a*,170*b* are advanced to a second station of clip formation indicated at B, a length of wire is welded, or otherwise attached, between the spaced strips 170*a*,170*b* to form a straight connecting bridge 172. The ends of the wire extend laterally to an intermediate point of each strip 170*a*,170*b*. As the strips 170*a*,170*b* are advanced, a bridge 172 will be formed in each clip that will eventually be produced.

At the third station indicated at C, slots 124*a*,124*b* are punched in each of the strips 170*a*,170*b* laterally outward of the ends of the bridge 172 and inward of the outer edges of the strips 170*a*,170*b*. Elongate slots 124*a*,124*b* in succeeding clips thereafter will be formed at predetermined intervals along the longitudinal axes of the strips.

At the fourth station indicated at D, individual partially-formed clips 180 are severed from the strips 170*a*,170*b* and the downward legs 108*a*,108*b* are formed over a mandrel at each lateral side creating channels, or openings 110*a*,110*b*. The clip 180 is then moved away from the line of upstream interconnected clips yet to be separated. The configuration of the severed clip 180 is shown in the front and side views of FIG. 11. The legs 108*a*,108*b* are now configured and sized to receive and accommodate within the openings 110*a*,110*b* a laterally extending rebar.

When clip 180 is advanced to the fifth station indicated at E, the arch in the bridge 172 is formed over a mandrel defining a longitudinal tunnel, or opening 122, as shown in the front and side views of FIG. 12 and is configured and sized to receive and accommodate within the opening 122 a longitudinally extending rebar.

At the sixth station indicated at F, collation of the clip strips takes place. Continuous parallel cords 142*a*,142*b*, which other clips 100 have been previously attached, are positioned into respective slots 124*a*,124*b* and the sides of the clip pressed inward to close the slots slightly and hold the cords 142*a*,142*b* within the slots 124*a*,124*b*. The clips 100 are spaced slightly apart along the cords 142*a*,142*b* enabling the collated clips to be flexed relative to one another.

The collated clips 100 may be made into strips of clips arranged linearly in a series or they may be spirally coiled to form a roll of clips that is more compact.

Rebar Clinch Clip Installation Tool

As seen in FIGS. 28-45, a clip installation tool, generally designated 500, includes a frame 502, a die set, generally designated 504, at the lower end of the frame 502, an actuating mechanism, generally designated 506, extending from the upper end of the frame 502, and a clip magazine, generally designated 508, for holding collated clips 100 that will be delivered sequentially one at a time to the die set 504.

The frame 502 includes a pair of longitudinally extending side plates 510*a*,510*b* held in spaced relation by a plurality of laterally extending spacers, collectively designated 512, and a plurality of nuts and bolts, collectively designated 514.

The die set 502 includes a bifurcated anvil 520 fixed to the frame 502 and a bifurcated blade 522 movable toward and away from a crimping position with the anvil 520. Lateral motion of the blade 522 at the lower end of the tool 500 is limited by the side plates 510*a*,510*b* and longitudinal motion by a blade guide 524 and a pair of spacers 526*a*,526*b*.

Figure 40:
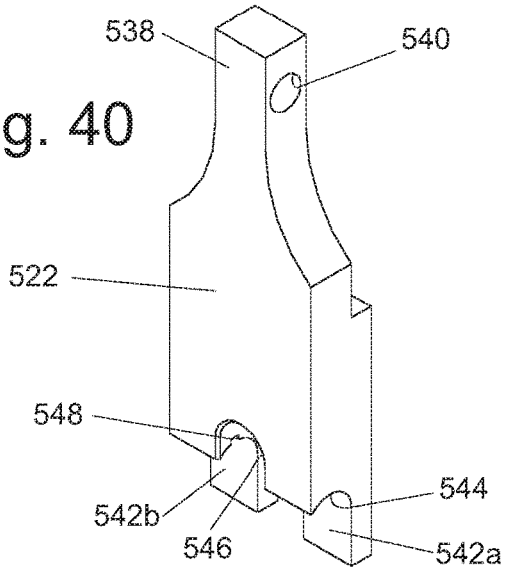
FIG. 40 is an enlarged top perspective view of the movable blade of the crimping tool.
Figure 41:
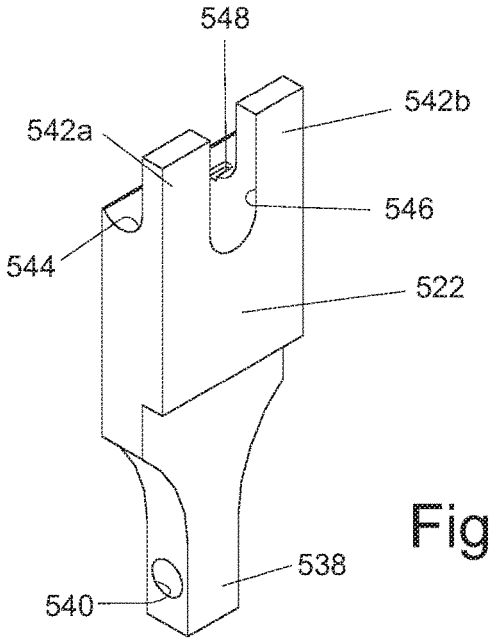
FIG. 41 is an enlarged bottom perspective view of the movable blade shown in FIG. 40.
Figure 42:
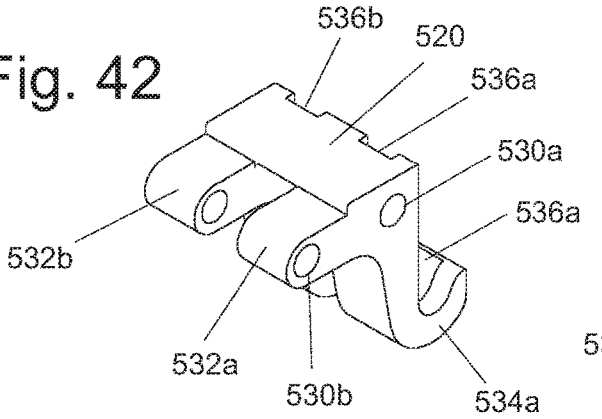
FIG. 42 is an enlarged top perspective view of the fixed anvil of the crimping tool.
Figure 43:
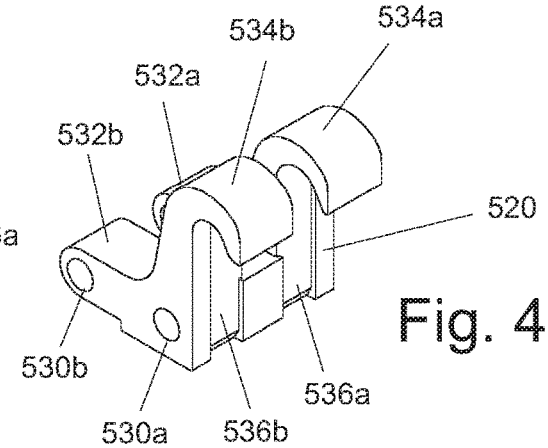
FIG. 43 is an enlarged bottom perspective view of the fixed anvil shown in FIG. 42.

The configuration of the anvil 520, blade 522, and blade guide 524 are best seen in FIGS. 40-45. As best seen in FIGS. 42 and 43, the anvil 520 has through hole 530*a* and through holes 530*b* formed in lugs 532*a*,532*b* for mounting the anvil 520 to the frame 502 and a pair of upwardly-opening concave finger elements 534*a*,534*b* at the front with grooves 536*a*,536*b* conforming to the shape and size of the legs of the clip 100 to accept and guide their movement along the anvil 520.

As best seen in FIGS. 40 and 41, the blade 522 has top and bottom portions with a through hole 540 formed in the narrow top portion 538 and a pair of downwardly-opening concave finger elements 542*a*,542*b* with a concave surface 544 at the rear separated by U-shaped slot 546 with a groove 548 conforming to the shape and size of the top of a clip 100. The concave elements 534*a*,534*b* and 542*a*,542*b* generally correspond to the exposed outward surfaces of the rebar being tied together.

Figure 44:
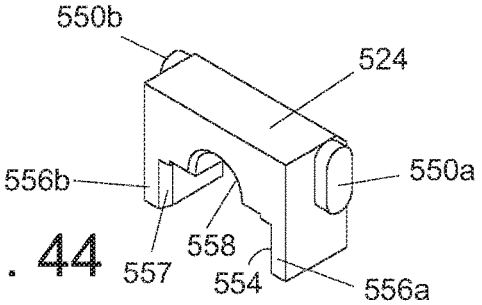
FIG. 44 is an enlarged top perspective view of the blade guide of the crimping tool; and, FIG. 45 is an enlarged bottom perspective view of the blade guide shown in FIG. 44.
Figure 45:
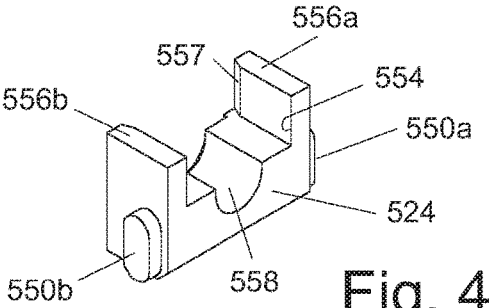

As best seen in FIGS. 44 and 45, the blade guide 524 has side lugs 550*a*,550*b* held in slots 552*a*,552*b* in the side plates 510*a*,510*b* and an opening 554 defined by opposed spaced legs 556*a*,556*b* having a cross-section generally conforming to the cross-section of a clip 100. The opening 554 includes an arch 558 at its inner end and a chamfer 557 along the edges to guide clips into position within the opening 554.

Herein, the tool 500 is used to connect rebar having a diameter of about ⅜ inch. However, the same tool may be modified for use with rebar of larger or smaller diameter by changing the blade, anvil, blade guide, and magazine that is being used.

The actuating mechanism 506 includes a pair of arms 560*a*,560*b* pivotally mounted between the side plates 510*a*, 510*b*. The inner ends of the arms 560*a*,560*b* are connected to one end of elongate drawbars 562*a*,562*b* by way of links 564*a*,564*b*. The other end of the elongate drawbars 562*a*, 562*b* are connected to the movable blade 522. A plurality of spacers, collectively designated 566, provide spacing between the various elements. The drawbars 562*a*,562*b* are limited to linear movement by guide pins 570 that travel in longitudinal slots 572 formed in the side plates 510*a*,510*b*, which may also limit the amount of drawbar travel.

Grip handles 574*a*,574*b* at the outer ends of the arms 560*a*,560*b* provide means allowing a user to hold and operate the tool 500. Upward motion of the handle ends of the arms 560*a*,560*b* closes the inner ends of the arms extending the links 564*a*,564*b* and thereby pushing the drawbars 562*a*,562*b* downward which in turn moves the blade 522 toward the anvil 520. Conversely, pushing the handles 574*a*,574*b* downward opens the links 564*a*,564*b* and drawbars 562*a*,562*b* retracting the blade 522 away from the anvil 520.

The clip magazine 508 is attached to the frame 502 at its upper end by a horizontal multi-angled magazine arm 580 fixed to side plate 510*b* and its lower end by a bolting flange 584 between the anvil lugs 532*a*,532*b*. The clip magazine 508 includes a housing 590 having a rectangular cross-section with two channels 592*a*,592*b* separated by an intermediate wall 594, a cover 596 at one side, and a pusher mechanism 600. The clip magazine 508 extends vertically from an upper end 602 having an opening 604 for loading collated clips 140 to a curved lower end 606 extending horizontally inward to deliver clips to the die set 502. The collated clips 140 are loaded into the clip magazine 508 with the U-shaped bridge element 104 of the clips straddling the intermediate wall 594 and the legs 108*a*,108*b* of the clips retained in their respective channels 592*a*,592*b*.

The pusher mechanism 600 includes an elongate feed rail 610 with a generally rectangular cross-section, a pusher 612 mounted for travel along the feed rail 610, and a spring 614 coiled around a spring rod 616 biasing the pusher 612 downward. The pusher 612 is fixed to one end of the spring rod 616 and includes a clip pusher 618 and a torsion spring 620 biasing the clip pusher 618 toward the top edge of the intermediate wall 584. The upper end of the feed rail 610 is fixed to the center section of the magazine arm 580 and the upturned lower end of the feed rail 610 is fixed to mounting block 622. Rod block 624 is fixed to the center section of the magazine arm 580 and includes an opening 626 through which the spring rod 616 is slidable. The pusher 612 has a pair of laterally-extending wings 628 allowing a user to manually pull the pusher 612 upward against spring pressure and a generally rectangular opening through which the feed rail 610 passes.

To load the clip magazine 508, the pusher 612 is manually raised against the force of the coiled spring 614 by pulling upward on the pusher block wings 628. Thereafter, collated clips 140 are loaded below the clip pusher 618 and the pusher 612 is released such that the clip pusher 618 moves against the rear of the loaded collated clips. During use, the coiled spring 614 will force the pusher 612 downward causing the clips to automatically be fed between the anvil 520 and the blade 522 when the blade 522 is retracted upward from the blade guide opening after clinching. It will be noted that as clips are removed from the magazine 508, the pusher 612 will move downwardly on the fixed feed rail 610 and the spring rod 616 fixed to the pusher 612 will slide downwardly within the rod block 624.

INDUSTRIAL APPLICABILITY

From the foregoing, it will be observed that numerous variations and modifications may be effected without departing from the spirit and scope of the invention. It will also be observed that the various elements of the invention may be in any number of combinations, and that all of the combinations are not enumerated here. It will be understood that no limitation with respect to the specific apparatus illustrated herein is intended or should be inferred. While specific embodiments of the invention have been disclosed, one of ordinary skill in the art will recognize that one can modify the materials, dimensions and particulars of the embodiments without straying from the inventive concept.

Other aspects, objects and advantages of this invention can be obtained from a study of the drawings, the foregoing disclosure and the attached claims.

It should be understood that the terms "top," "bottom," "forward," "rear," "rearward," "upper," "lower," "inner," "outer," "side," "lateral," "end," "height," "width," "length," "horizontal," "vertical," and similar terms as used herein, have reference only to the structure shown in the drawings and are utilized only to facilitate describing the invention. The terms and expressions employed herein have been used as terms of description and not of limitation.

As used herein, the term "vertical" shall mean in a direction generally indicating the height of an object, such as distance between the top and bottom of the climping tool; the term "longitudinal" shall mean in a direction generally along the length of an object from front to back, such as the direction of the upper rebar extends as shown herein; and, the term "lateral" shall mean in a direction generally orthogonal to vertical and to longitudinal, such as the direction of the lower rebar extends as shown herein.

As used herein, the term "within" shall mean "to be partially or completely inside of"; the term "axial" refers to a direction that is substantially straight; the term "transverse" refers to a direction other than the axial direction (e.g., orthogonal or nonorthogonal).

What is claimed is:

1. A clinch clip for binding a first rebar extending in a first direction to an underlying second rebar extending in a second direction transverse to the first direction, the clinch clip comprising:

a pair of crimp elements in spaced relation, each crimp element having a pair of spaced legs connected by a bight portion to form a U-shaped opening orthogonal to the second direction, the space between the legs and the size of the opening of the crimp element having a dimension allowing fitment over the second rebar with the bight portion of the crimp element overlying the second rebar;

a bridge element having a pair of spaced arms connected by a bight portion to form a U-shaped opening orthogonal to the first direction, the space between the arms and the size of the opening of the bridge element having a dimension allowing fitment over the first rebar with the bight portion of the bridge portion overlying the first rebar;

each arm of the bridge element having a finger extending outward from the opening of the bridge element;

the bridge element spanning the space between the crimp elements with the fingers overlapping and being attached to the respective bight portions of the crimp elements to form a clinch clip; and, whereby the bridge element may be at least partially wrapped around the first rebar and the crimp elements may be deformed to be at least partially wrapped around the second rebar to bind the rebars together.

2. The clinch clip of claim 1 wherein the crimp elements and the bridge element are separately formed metal components with the crimp elements being fused to the bridge element.

3. The clinch clip of claim 2 wherein the crimp elements and the bridge element are made of steel.

4. The clinch clip of claim 3 wherein the fingers of the bridge element are welded to the bight portions of the crimp elements.

5. The clinch clip of claim 1 wherein the fingers of the bridge element are mechanically attached to the bight portions of the crimp elements.

6. The clinch clip of claim 5 wherein a plurality of cutouts are formed in the fingers of the bridge element and the crimp elements have a plurality of prongs with the prongs extending from the crimp elements through the cutouts and overlapping the fingers of the bridge element to fix the crimp elements to the bridge element.

7. The clinch clip of claim 1 wherein the bight portion of the bridge element is arcuate and the arms of the bridge element extend outward in parallel from the ends of the bight portion of the bridge element to a free end.

8. The clinch clip of claim 1 wherein the bight portion of each crimp element is arcuate and the legs of each crimp element extend outward in parallel from the bight portion of each crimp element to a free end.

9. The clinch clip of claim 8 wherein each leg of the crimp elements has a tapering configuration narrowing from the bight portion of the crimp element to its free end.

10. The clinch clip of claim 9 wherein the legs of each crimp element are offset relative to one another in the second direction whereby the legs bypass each other when wrapped around the second rebar.

11. The clinch clip of claim 1 wherein each crimp element includes an opening slot formed in the bight portion of the crimp element for receiving a cord.

12. The clinch clip of claim 1 wherein each crimp element includes a slot formed in the bight portion of the crimp element outward from the ends of each finger of the bridge element for receiving a cord.

13. A plurality of clinch clips as set forth in claim 1 arranged in side-by-side relation and further including at least one cord attached to and extending between adjacent clinch clips whereby the plurality of clinch clips are connected together.

14. A plurality of clinch clips as set forth in claim 1 arranged in side-by-side relation and further including at least one cord mechanically attached to and extending between adjacent clinch clips whereby the plurality of clinch clips are connected together.

15. The clinch clip of claim 1 wherein the crimp elements have a rectangular cross-section.

16. The clinch clip of claim 1 wherein the bridge element has a circular cross-section.

17. The clinch clip of claim 1 wherein the bridge element has a rectangular cross-section.

18. A clinch clip for binding a first rebar extending in a first direction to an underlying second rebar extending in a second direction transverse to the first direction, the clinch clip comprising:

a pair of crimp elements in spaced relation, each crimp element having a pair of spaced legs connected by a bight portion to form a U-shaped opening orthogonal to the second direction, the space between the legs and the size of the opening of each crimp element having a dimension allowing fitment over the second rebar with the bight portion of the crimp portion overlying the second rebar;

a bridge element having a pair of spaced arms connected by a bight portion to form a U-shaped opening orthogonal to the first direction, the space between the arms and the size of the opening of the bridge element having a dimension allowing fitment over the first rebar with the bight portion of the bridge element overlying the first rebar;

each arm of the bridge element having a finger extending outward from the opening of the bridge element;

the crimp elements and the bridge element being separately formed metal components;

the bridge element spanning the space between the crimp elements with the fingers overlapping and being attached to the respective bight portion of the crimp elements to form a clinch clip;

the bight portion of each crimp element including an opening slot formed in the bight portion outward from the ends of each bridge element finger for receiving a cord; and, whereby the bridge element may be at least partially wrapped around the first rebar and the crimp elements may be deformed to be at least partially wrapped around the second rebar to bind the rebars together.

19. The clinch clip of claim 18 wherein the crimp elements and the bridge element are separately formed components made of steel with the fingers of the bridge element welded to the bight portions of the crimp elements.

20. The clinch clip of claim 1 wherein a plurality of cutouts are formed in the fingers of the bridge element and the crimp elements have a plurality of prongs with the prongs extending from the crimp elements through the cutouts and overlapping the fingers of the bridge element to mechanically fix the crimp elements to the bridge element.

* * * * *